US007337790B2

(12) United States Patent
Ha

(10) Patent No.: US 7,337,790 B2
(45) Date of Patent: Mar. 4, 2008

(54) DISHWASHER

(75) Inventor: Jae Hoon Ha, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 462 days.

(21) Appl. No.: 10/721,175

(22) Filed: Nov. 26, 2003

(65) Prior Publication Data

US 2004/0103929 A1 Jun. 3, 2004

(30) Foreign Application Priority Data

Nov. 28, 2002 (KR) ..... 10-2002-0075063

(51) Int. Cl.
*B08B 3/02* (2006.01)

(52) U.S. Cl. ..... 134/56 D; 134/95.3; 134/184

(58) Field of Classification Search ..... 134/56 D, 134/184, 95.3, 199; 137/533.11, 533.12, 137/533.13, 533.14, 533.15
See application file for complete search history.

(56) References Cited

U.S. PATENT DOCUMENTS 2,018,769 A * 10/1935 Tryon ..... 137/515.7
2,395,968 A * 3/1946 Hiort AF Ornas ..... 134/56 D
2,918,927 A * 12/1959 Clearman ..... 134/200
2,962,048 A * 11/1960 Steidley ..... 137/565.17
3,106,164 A * 10/1963 McCormick ..... 417/383
3,530,864 A * 9/1970 Wright ..... 134/58 D
3,613,720 A * 10/1971 Welch ..... 137/527.8
4,741,353 A * 5/1988 Milocco ..... 137/119.03
4,754,770 A * 7/1988 Fornasari ..... 134/57 D
5,331,986 A * 7/1994 Lim et al. ..... 134/88
5,579,790 A * 12/1996 Edwards et al. ..... 134/104.1
5,849,101 A * 12/1998 Edwards et al. ..... 134/105
6,705,330 B1 * 3/2004 Favret ..... 134/56 D
6,997,196 B2 * 2/2006 Eiermann ..... 134/105
2003/0159720 A1 * 8/2003 Favret ..... 134/57 D

FOREIGN PATENT DOCUMENTS

FR 2 431 278 * 2/1980

* cited by examiner

*Primary Examiner*—Frankie L. Stinson
(74) *Attorney, Agent, or Firm*—Ked & Associates, LLP

(57) ABSTRACT

Disclosed is a dishwasher, in which upper and lower pipes are opened/closed using a water pressure to simplify a configuration of the dishwasher and to reduce product costs. The present invention includes a washing chamber, top and bottom nozzles injecting water in the washing chamber, a sump provided under the washing chamber to store the water, a pump pumping the water stored in the sump, a supply pipe adjacent to one side of the pump wherein the water pumped by the pump flows in the supply pipe, upper and lower pipes leading the water to the top and bottom nozzles, respectively, and a valve assembly connecting the supply pipe to the upper and lower pipes to selectively open/close the upper or lower pipe using a pressure of the pumped water.

24 Claims, 4 Drawing Sheets

DISHWASHER

This application claims the benefit of Korean Application(s) No. 10-2002-0075063 filed on Nov. 28, 2002 which is/are hereby incorporated by reference.

BACKGROUND OF THE INVENTION

1. Field of the Invention

The present invention relates to a dishwasher.

2. Discussion of the Related Art

Generally, a dishwasher is an apparatus for automatically washing and drying tableware by injecting water and detergent on the tableware. A dishwasher according to a related art is explained by referring to the attached drawings.

FIG. 1 is a cross-sectional view of a dishwasher according to a related art.

Referring to FIG. 1, a dishwasher according to a related art mainly consists of a cabinet 2 having a large open front side, a washing chamber 4 provided in the cabinet 2, and a door 6 opening closing the open front side of the cabinet 2.

Upper and lower racks 8 and 9 on which tableware is put are provided in the washing chamber 4, and top and bottom nozzles 12 and 14 injecting water via injection holes 10 are rotatably provided under the upper and lower racks 8 and 9, respectively.

A sump 16 is provided under the washing chamber 4 to collect water therein. A pump 24 connected to a supply pipe 22 is provided at one side of the sump 16 to pump water to the top and bottom nozzles 12 and 14. And, a heater assembly (not shown in the drawing) for heating water held in the sump 16 is provided in the sump 16.

The supply pipe 22 is connected to upper and lower pipes 26 and 28 guiding water to the top and bottom nozzles 12 and 14, respectively. Hence, when the pump 24 operates, the water in the sump 16 is supplied to the top and bottom nozzles 12 and 14 via the supply pipe 22 and the upper and lower pipes 26 and 28. Inlet valve and pipe for supplying water to the sump 16 and drain pump assembly and pipe for draining the water in the sump are installed at one side of the sump 16.

And, a filter 18 is installed over the sump 16 to filter the water flowing in the sump 16 from the washing chamber 4 to remove particles from the water.

Meanwhile, a valve assembly 30 for electrically opening/closing the upper and lower pipes 26 and 28 is installed at a portion where the upper and lower pipes 26 and 28 are connected to the supply pipe 22 to selectively allow the water flow in.

FIG. 2 is a cross-sectional view of a valve assembly of a dishwasher according to a related art.

Referring to FIG. 2, the valve assembly 30 consists of protrusions 32*a* and 32*b* formed inside the upper and lower pipes 26 and 28, respectively, a pair of check valves 34*a* and 34*b* and a pair of solenoid valves 36*a* and 36*b*.

The check valves 34*a* and 34*b* are movably installed in the upper and lower pipes 26 and 28 to open/close the upper and lower pipes 26 and 28, respectively. And, the solenoid valves 36*a* and 36*b* are installed under the check valves 34*a* and 34*b* to turn on/off the check valves 34*a* and 34*b* by magnetic forces, respectively.

Of course, the check valves 34*a* and 34*b* are magnetic bodies movable by the magnetic forces on operating the solenoid valves 36*a* and 36*b*, respectively.

An operation of the related art dishwasher is explained in short as follows.

First of all, once the pump 24 is driven, the check valves 34*a* and 34*b* are moved upward by the water flowing in via the supply pipe 22 to be brought contact with the protrusions 32*a* and 32*b*, respectively. Hence, the check valves 34*a* and 34*b* blocks the upper and lower pipes 26 and 28 to prevent the water from flowing in the upper and lower pipes 26 and 28, respectively.

Thereafter, once a pair of the solenoid valves 36*a* and 36*b* are driven, the check valves 34*a* and 34*b* move downward by the magnetic forces to open the upper and lower pipes 26 and 28, respectively. Hence, the water is supplied to the top and bottom nozzles 12 and 14 via the upper and lower pipes 26 and 28, respectively.

Yet, when both of the upper and lower pipes 26 and 28 are open by driving a pair of the solenoid valves 36*a* and 36*b* simultaneously, the water is supplied to the top and bottom nozzles 12 and 14 along the upper and lower pipes 26 and 28, respectively so that the water pressures and injection powers thereof are lowered. Hence, the solenoid valves 36*a* and 36*b* are selectively operated to supply the water via either the upper or lower pipe 26 or 28.

However, in the related art dishwasher, the magnetic check valves are provided in the upper and lower pipes and the check valves are turned on/off by the expensive solenoid valves, respectively, whereby product costs are increased.

Moreover, since the solenoid valves are electrically driven, electric safety accident may take place as well as power consumption thereof increases.

SUMMARY OF THE INVENTION

Accordingly, the present invention is directed to a dishwasher that substantially obviates one or more of the problems due to limitations and disadvantages of the related art.

An object of the present invention, which has been devised to solve the foregoing problem, lies in providing a dishwasher, in which upper and lower pipes are opened/closed using a water pressure to simplify a configuration of the dishwasher and to reduce product costs thereof.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dishwasher including a washing chamber, top and bottom nozzles injecting water in the washing chamber, a sump provided under the washing chamber to store the water, a pump pumping the water stored in the sump, a supply pipe adjacent to one side of the pump wherein the water pumped by the pump flows in the supply pipe, upper and lower pipes leading the water to the top and bottom nozzles, respectively, and a valve assembly connecting the supply pipe to the upper and lower pipes to selectively open/close the upper or lower pipe using a pressure of the pumped water.

The driving valve assembly includes a guide having an inlet hole connected to the supply pipe at top, the guide having first and second holes connected to the upper and lower pipes, respectively formed at a bottom, the guide having an inner passage circulating inside and a ball moving along the inner passage to selectively open/close the first or second outlet hole.

And, a diameter of the ball is greater than that of each of the inlet hole and the first and second outlet holes. The guide includes a first guide having the inlet hole and a second guide having the first and second holes.

Moreover, a rib protrudes upward from a circumference of the first guide and a groove is formed in a circumference of the second guide to be coupled to the rib. Preferably, a diameter of the ball is greater than that of each of the inlet hole and the first and second outlet holes.

Meanwhile, the inner passage is so slant that the ball can move in one direction. Specifically, the inner passage includes a first passage slant upward from the inlet hole toward the first outlet hole, a second passage slant upward from the first outlet hole toward the second outlet hole, and a third passage slant downward from the second outlet hole toward the inlet hole.

And, a first step is formed on an upper inside of the guide to prevent the ball lying at the inlet hole from moving toward the third passage by the pressure of the water.

Moreover, a second step is formed on a lower inside of the guide to prevent the ball lying at a lower side of the first outlet hole from moving along the first passage. And, a third step is formed on a lower inside of the guide to prevent the ball lying at a lower side of the second outlet hole from moving along the second passage.

Meanwhile, a protrusion is formed between the first and second outlet holes to prevent the ball blocking the first outlet hole from moving to the second outlet hole along the second passage.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
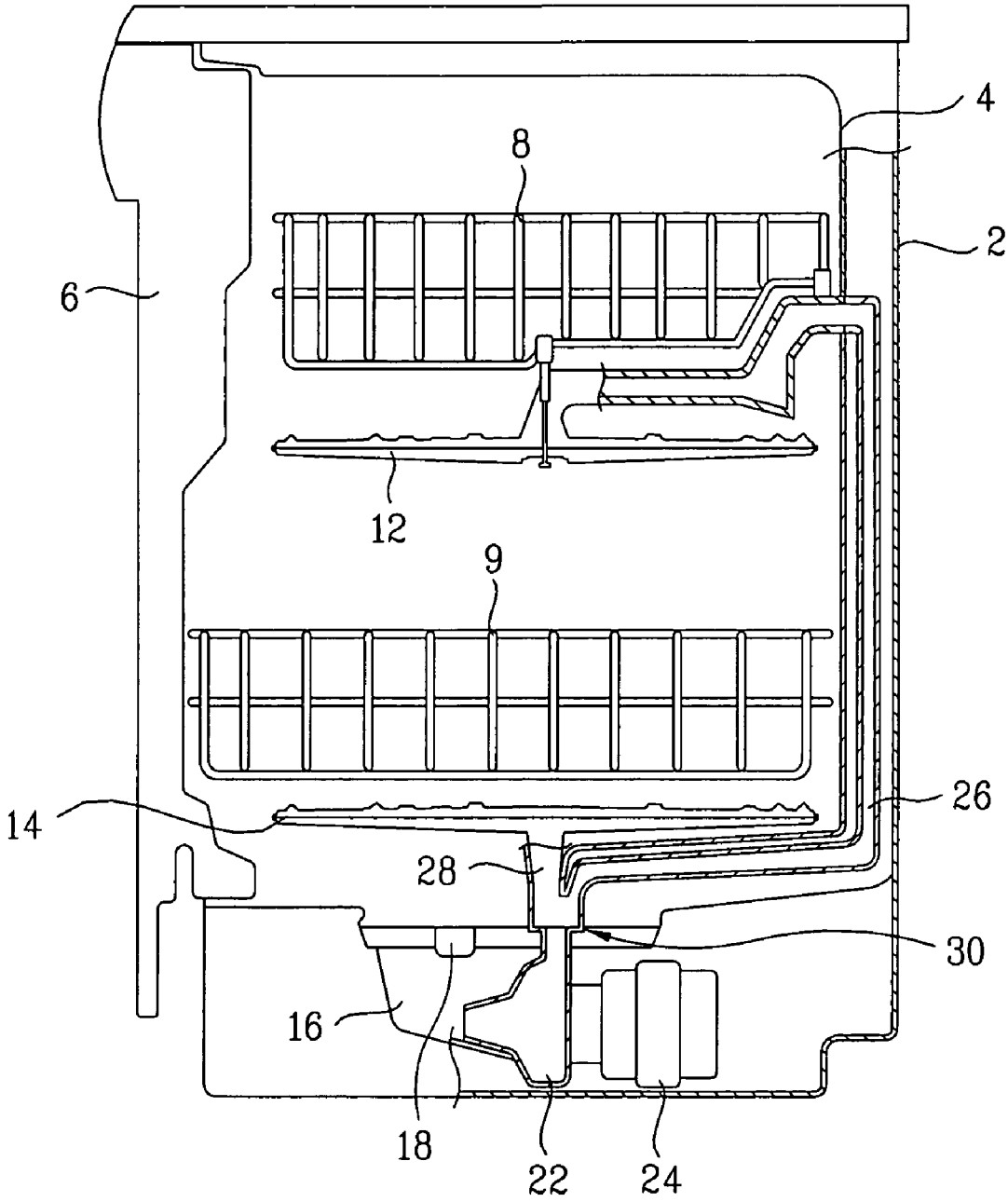
FIG. 1 is a cross-sectional view of a dishwasher according to a related art.
Figure 2:
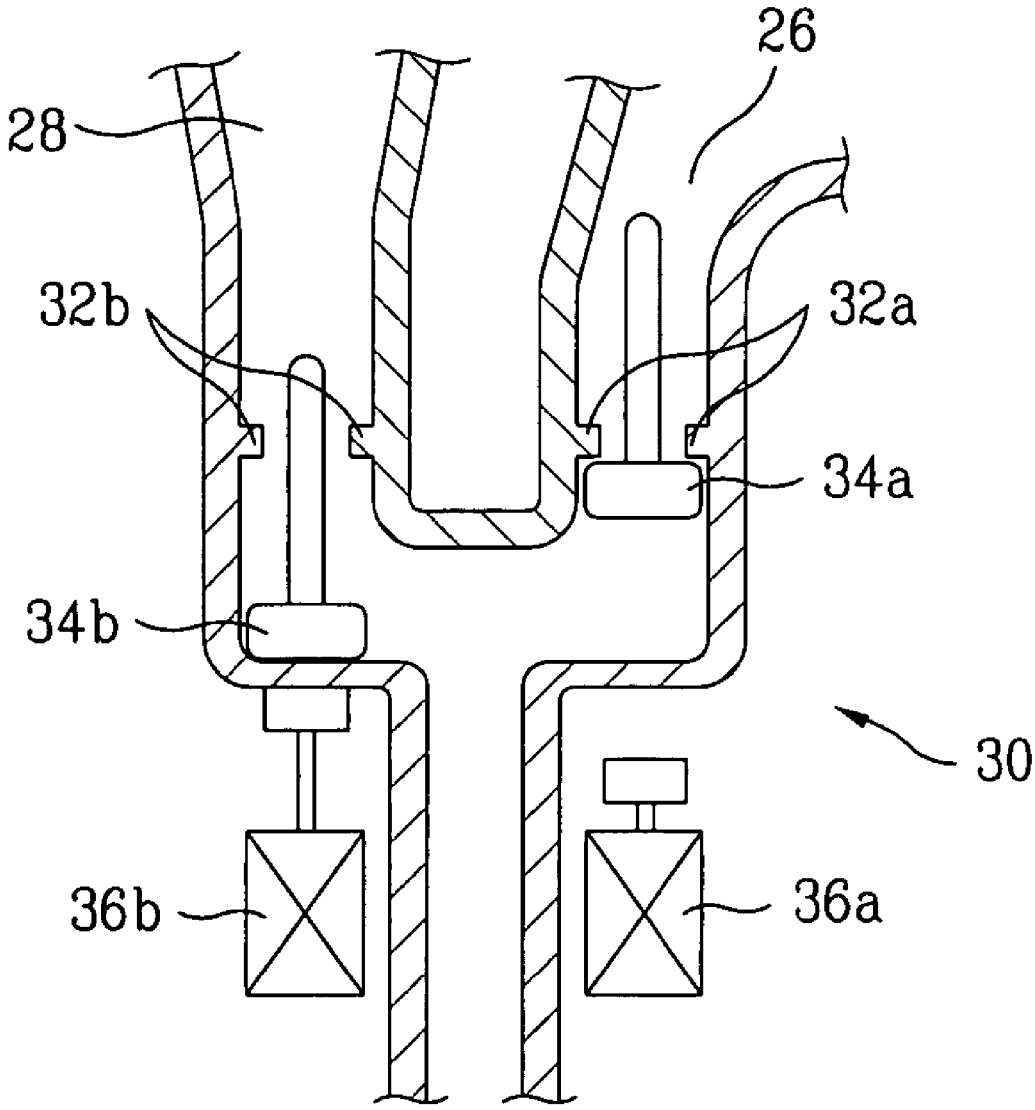
FIG. 2 is a cross-sectional view of a valve assembly of a dishwasher according to a related art.
Figure 3:
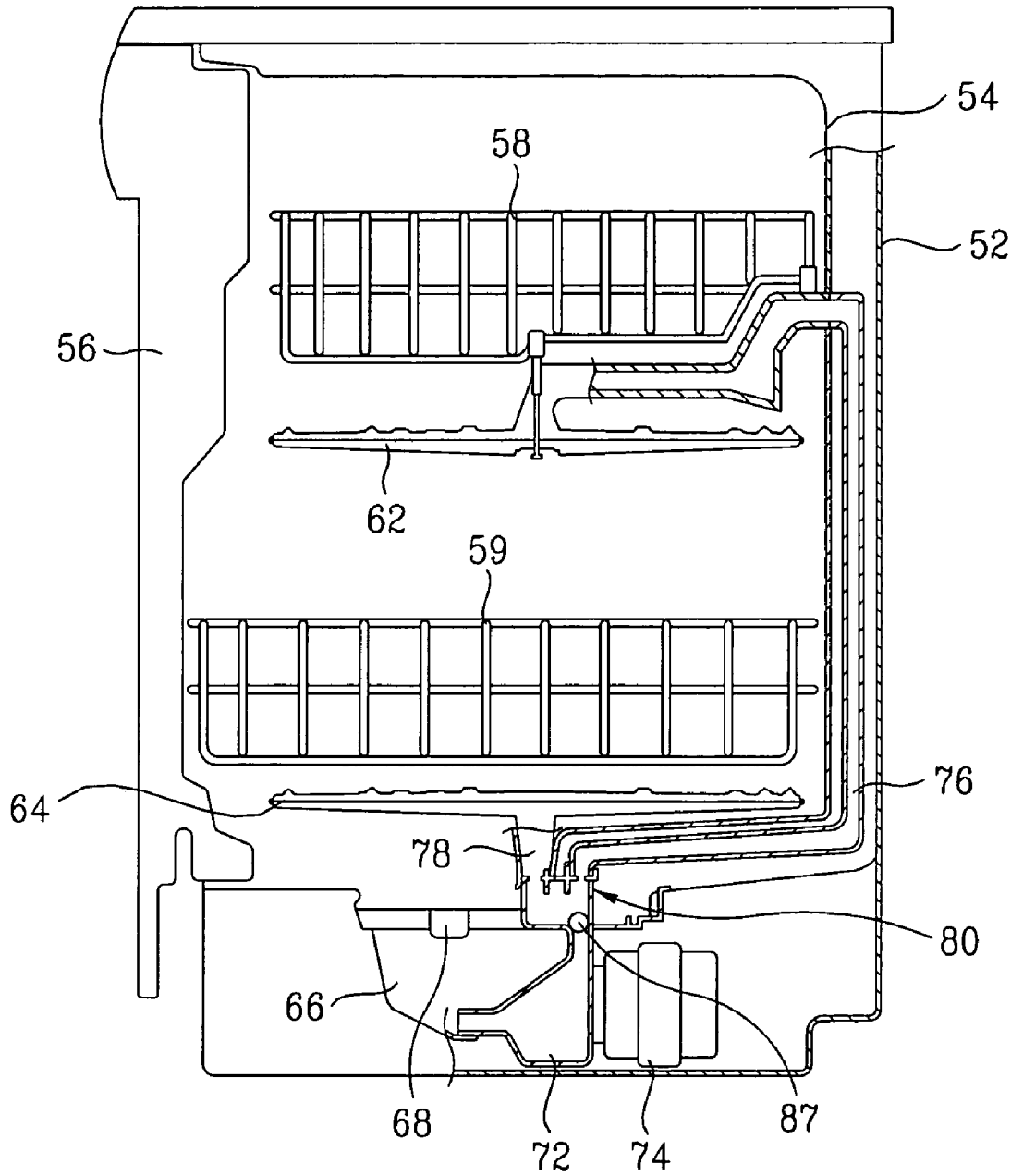
FIG. 3 is a cross-sectional partial view of a dishwasher according to the present invention.

FIG. 3 is a cross-sectional partial view of a dishwasher according to the present invention.

Referring to FIG. 3, a dishwasher according to the present invention includes a cabinet 52 having a large open front side, a washing chamber 54 provided in the cabinet 52, and a door 56 opening closing the open front side of the cabinet 52.

Upper and lower racks 58 and 59 on which tableware is put are provided in the washing chamber 54 to slide in and out, and top and bottom nozzles 62 and 64 injecting water via injection holes (not shown in the drawing) are rotatably provided under the upper and lower racks 58 and 59, respectively.

A sump 66 is provided under the washing chamber 54 to collect water therein. A pump 74 pumping water and a supply pipe 72 in which the water pumped by the pump 74 flows are provided at one side of the sump 66.

Although not shown in the drawing, a heater assembly for heating water held in the sump 66 is provided in the sump 16. Inlet valve and pipe for supplying water to the sump 66 and drain pump assembly and pipe for draining the water in the sump are installed at one side of the sump 66.

And, a filter 68 is installed over the sump 66 to filter the water flowing in the sump 66 from the washing chamber 54 to remove particles from the water.

Meanwhile, a valve assembly 80 for connecting the supply pipe 72 to the upper and lower pipes 76 and 78 is installed between the supply pipe 72 and the upper and lower pipes 76 and 78. And, the valve assembly 80 selectively opens/closes the upper and lower pipes 76 and 78 using a pressure of the water pumped by the pump 74.

Figure 4:
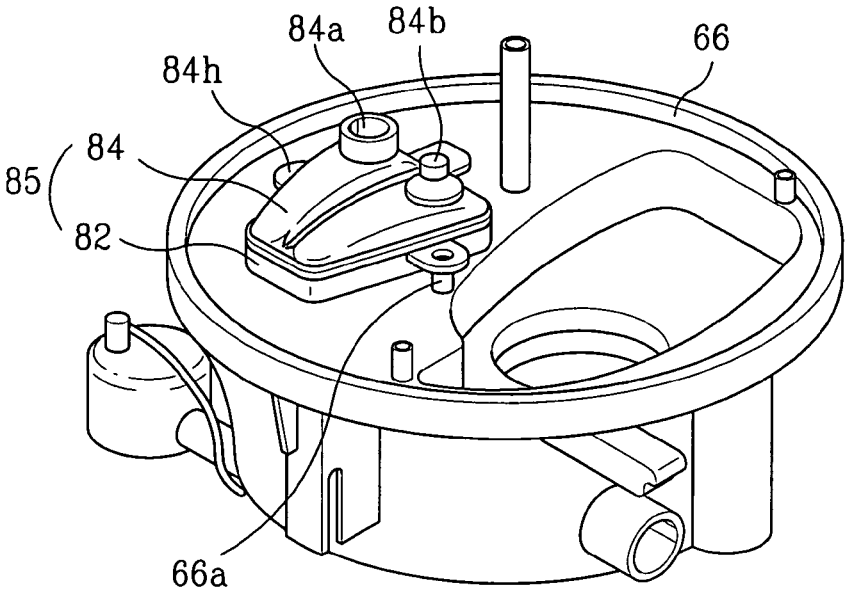
FIG. 4 is a perspective view of a valve assembly according to the present invention.
Figure 5:
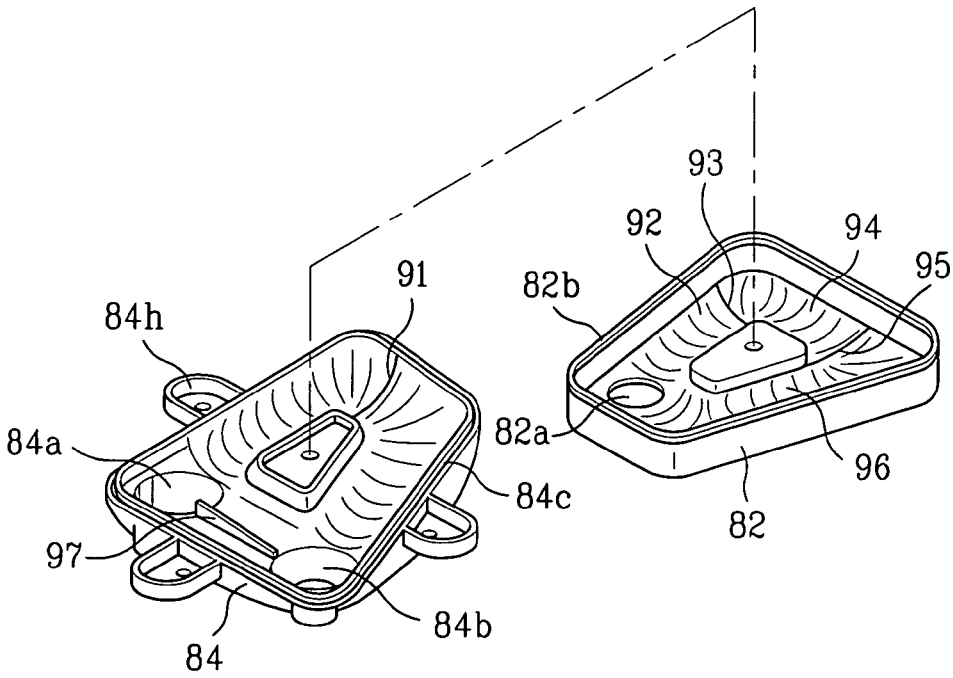
FIG. 5 is a perspective view of a disassembled guide according to the present invention.

FIG. 4 is a perspective view of a valve assembly according to the present invention and FIG. 5 is a perspective view of a disassembled guide according to the present invention.

Referring to FIG. 4 and FIG. 5, the valve assembly 80 includes a guide 85 connecting the supply pipe 72 to the upper and lower pipes 76 and 78 and a ball 87 (cf. FIG. 3) provided in the guide 85.

An inlet hole 82*a* connected to the supply pipe 72 is formed at a bottom of the guide 85, first and second outlet holes 84*a* and 84*b* connected to the upper and lower pipes 76 and 78, respectively are formed at a top of the guide 85, and an inner passage is formed inside the guide 85 to circulate.

And, the ball 87 moves along the inner passage inside the guide 85 to selectively open/close the first and second outlet holes 84*a* and 4*b*.

In this case, a diameter of the ball 87 is smaller than that of the inner passage to move along inside the guide 85, but is greater than that of each of the inlet hole 82*a* and the first and second outlet holes 84*a* and 84*b* since the ball 87 has to block the inlet hole 82*a* and the first and second outlet holes 84*a* and 84*b* selectively.

The ball 87 is normally formed spherical, but may be fabricated oval.

Meanwhile, the guide 85 may includes a first guide 82 having the inlet hole 82 and a second guide 84 having the first and second outlet holes 84*a* and 84*b*.

In this case, a rib 82*b* is formed to protrude from a circumference of the first guide 82, and a groove 84*c* is formed at a circumference of the second guide 84 to be coupled to the rib 82*b*. Hence, the first and second guides 82 and 84 are coupled to each other by the rib 82*b* and groove 84*c*.

And, a plurality of coupling portions 84*h* are formed on the circumference of the second guide 84. The coupling portions 84*h* are coupled to a plurality of coupling bosses 66*a* formed at the sump 66, respectively to fix the guide 85 to a topside of the sump 66.

Specifically, screw holes are formed at the coupling portions 84*h* and the coupling bosses 66*a*, respectively, and the coupling portions 84*h* are coupled to the coupling bosses 66*a* by screws, respectively.

Meanwhile, the inner passage is formed slant to enable the ball 87 to move in one direction. Namely, the inner passage includes a first passage 92 slant upward from the inlet hole 82*a* toward the first outlet hole 84*a*, a second passage 94 slant upward from the first outlet hole 84*a* toward the second outlet hole 84*b*, and a third passage 96 slant downward from the second outlet hole 84*b* toward the inlet hole 82*a*.

And a first step 91 is formed on an upper inside of the guide 85 to prevent the ball 87 lying at the inlet hole 82*a* from moving toward the third passage 96 by a pressure of the water.

Moreover, a second step 93 preventing the ball 87 lying at a lower side of the first outlet hole 84*a* from moving to the inlet hole 84*a* along the first passage 92 and a third step 95 preventing the ball lying at a lower side of the second outlet hole 84*b* from moving along the second passage 94 to the first outlet hole 84*a* are formed on a lower inside of the guide 85.

Besides, a protrusion 97 is formed between the first and second outlet holes 84*a* and 84*b* to prevent the ball 87 blocking the first outlet hole 84*a* from moving to the second outlet hole 84*b* along the second passage 94 by the pressure of the water.

Functions of the first to third steps 91, 93, and 95 and the protrusion 97 will be explained in explaining an operation of the dishwasher as follows.

An operation of the above-constructed dishwasher according to the present invention is explained as follows.

First of all, once power is applied to the dishwasher to operate, the inlet valve (not shown in the drawing) is turned on to have the water flow in the sump 66. The water flowing in the sump 66 is then pumped by the pump 74.

The water pumped by the pump 74 flows in the guide along the supply pipe 72. In this case, the ball 87 lying at the inlet hole 82*a* ascends by the pressure of the water to move to block the first outlet hole 84*a* along the first passage 92.

In doing so, the ball 87 may move toward the third passage 96 by the pressure of the water. Yet, the ball 87 is interrupted by the first step 91 on the upper inside of the guide 85 not to move along the third passage 96 but to move to block the first outlet hole 84*a* along the first passage 92.

Moreover, in blocking the first outlet hole 84*a*, the ball 87 is held by the protrusion 97 between the first and second outlet holes 84*a* and 84*b* to prevent from moving. Namely, receiving the water pressure, the ball 87 intends to move toward the second outlet hole 84*b* along the first and second passages 92 and 94 slant upward. Yet, the ball 87 is prevented from moving to the second outlet hole 84*b* by the protrusion 97.

Hence, the water is not supplied to the upper pipe 76 but is injected into the washing chamber 54 via the second outlet hole 84*b*, lower pipe 78, and bottom nozzle 64, in turn.

Thereafter, if the pump 74 stops operating, the pressure of the water is lowered so that the ball 87 descends in the first outlet hole 84*a*. The descending ball 87 is then held by the second step 93 to lie at the lower side of the first hole 84*a*. Namely, after descending in the first outlet hole 84*a*, the ball 87 intends to return to the inlet hole 82*a* along the slant first passage 92. In this case, the ball 87 is held by the second step 93 not to roll down along the first passage but to stop.

And, once the pump 74 operates again, the ball 87 moves to the second outlet hole 84*b* along the second passage 94 by the pressure of the water and then blocks the second outlet hole 84*b*.

Hence, the water is not supplied to the lower pipe 78 but is injected into the washing chamber 54 via the open first outlet hole 84*a*, upper pipe 76, and top nozzle 62, in turn.

If the pump 74 stops operating again, the ball 87 descends in the second outlet hole 84*b* as the pressure of the water is lowered. The ball 87 then moves along the third passage 96 to return to the inlet hole 82*a*.

In doing so, the ball 87 may move along the second passage 94 but is prevented by the third step 95 from moving along the second passage 92.

Thus, the ball 87 moves along the inner passage inside the guide 85 according to the operation of the pump 74 to selectively block the first or second hole 84*a* or 84*b*, and the water is injected into the washing chamber 54 via the selectively opened upper or lower pipe 76 or 78.

Accordingly, the dishwasher according to the present invention has the following advantages or effects.

First of all, the ball provided inside the guide moves by the water pressure to open/close the upper or lower pipe, whereby the configuration is simplified as well as the product costs are reduced.

Secondly, the present invention does not adopt the electric device as the valve assembly, thereby enabling to prevent accidents to enhance product reliance.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dishwasher, comprising:

a washing chamber;

top and bottom nozzles injecting water in the washing chamber;

a sump provided under the washing chamber to store the water;

a pump pumping the water stored in the sump;

a supply pipe adjacent to one side of the pump wherein the water pumped by the pump flows in the supply pipe;

upper and lower pipes leading the water to the top and bottom nozzles, respectively; and a valve assembly connecting the supply pipe to the upper and lower pipes to selectively open/close the upper or lower pipe using a pressure of the pumped water, wherein the valve assembly comprises a first guide portion and a second guide portion that are coupled together to form a valve assembly housing which is separate from the pump, and wherein an inlet hole formed in the first guide portion is coupled to the supply pipe, wherein first and second outlet holes in the second guide portion are coupled, respectively, to the upper and lower pipes, and further comprising a bail that moves along a passage formed between the first and second guide portions to selectively open and close the first and second outlet holes.

2. The dishwasher as claimed in claim 1, wherein a diameter of the ball is greater than that of each of the inlet hole and the first and second outlet holes.

3. The dishwasher as claimed in claim 1, wherein the passage is slanted such that the ball can only move along the passage in one direction.

4. The dishwasher as claimed in claim 3, wherein the passage comprises:

a first passage slanted upward from the inlet hole toward the first outlet hole;

a second passage slanted upward from the first outlet hole toward the second outlet hole; and a third passage slanted downward from the second outlet hole toward the inlet hole.

5. The dishwasher as claimed in claim 4, where a step is formed on an inside of the second guide portion such that when the ball is lying at the inlet hole, the ball is prevented from moving toward the third passage by the pressure of the water.

6. The dishwasher of claim 5, wherein a step is formed on an inside of the first guide portion such that when the ball is lying at a lower side of the first outlet hole, the ball is prevented from moving along the first passage.

7. The dishwasher of claim 6, wherein a step is formed on an inside of the second guide portion such that when the ball is lying at a lower side of the second outlet hole, the ball is prevented from moving along the second passage.

8. The dishwasher of claim 7, wherein a protrusion is formed on the second guide portion such that when the ball is blocking the first outlet hole, the ball is prevented from moving along the second passage to the second outlet hole.

9. The dishwasher as claimed in claim 4, wherein a step is formed on an inside of the first guide portion such that when the ball is lying at a lower side of the first outlet hole, the ball is prevented from moving along the first passage.

10. The dishwasher a claimed in claim 4, wherein a step is formed on an inside of the second guide portion such that when the ball is laying at a lower side of the second outlet hole, the ball is prevented from moving along the second passage.

11. The dishwasher as claimed in claim 4, wherein a protrusion is formed on the second guide portion between the first and second outlet holes such that when the ball is blocking the first outlet hole, the ball is prevented from moving to the second outlet hole along the second passage.

12. The dishwasher of claim 1, wherein the valve assembly housing is connected to the pump via the supply pipe.

13. The dishwasher of claim 1, wherein a rib is formed on a circumference of one of the first and second guide portions, and a groove is formed on a circumference of the other of the first and second guide portions, and wherein the rib is received in the groove to couple the first and second guide portions.

14. A dishwasher, comprising:

a washing chamber;

a pump configured to pump washing water;

top and bottom nozzles configured to inject washing water from the pump into the washing chamber; and a valve assembly coupled to the pump and to the top and bottom nozzles, wherein the valve assembly is configured to selectively supply washing water from the pump to the top and bottom nozzles, and wherein the valve assembly comprises:

a passage that includes a first section that slants upward to connect an inlet from the pump to a first outlet to one of the top and bottom nozzles, a second section that slants upward to connect the first outlet to a second outlet to the other of the top and bottom nozzles, and a third section that slants downward to connect the second outlet to the inlet; and a ball that is configured to move along the passage.

15. The dishwasher of claim 14, wherein a step is formed in an upper portion of the passage adjacent the inlet such that when the ball is lying adjacent the inlet, the ball is prevented from passing along the third section when water is supplied into the inlet from the pump.

16. The dishwasher of claim 14, wherein a step is formed on the passage adjacent the first outlet such that when the ball is located adjacent the first outlet, the ball is prevented from moving along the first passage.

17. The dishwasher of claim 14, wherein a step is formed on the passage adjacent the second outlet such that when the ball is located adjacent the second outlet, the ball is prevented from moving along the second passage.

18. The dishwasher of claim 14, wherein a protrusion is formed on an upper portion of the passage between the first and second outlets such that when the ball is blocking the first outlet, the ball is prevented from moving along the second passage to the second outlet.

19. A dishwasher, comprising:

a washing chamber;

a pump configured to pump washing water;

top and bottom nozzles configured to inject washing water from the pump into the washing chamber; and a valve assembly coupled to the pump and to the top and bottom nozzles, wherein the valve assembly is configured to selectively supply washing water from the pump to the top and bottom nozzles, and wherein the valve assembly comprises:

a passage that forms a horizontally arranged circuit passing from an inlet from the pump to a first outlet to one of the top and bottom nozzles, then from the first outlet to a second outlet to the other of the top and bottom nozzles, and then from the second outlet back to the inlet; and a ball that is configured to move along the passage to sequentially block the first and second outlets.

20. The dishwasher of claim 19, wherein the passage includes a first section that slants upward from the inlet to the first outlet, a second section that slants upward from the first outlet to the second outlet, and a third section that slants downward from the second outlet to the inlet.

21. The dishwasher of claim 20, wherein a protrusion is formed on an upper portion of the second section such that when the ball is blocking the first outlet, the ball is prevented from moving from the first outlet to the second outlet.

22. The dishwasher of claim 20, wherein a step is formed on a bottom portion of the passage adjacent the first outlet to prevent the ball from rolling from a position under the first outlet back to the inlet.

23. The dishwasher of claim 20, wherein a step is formed on a bottom portion of the passage adjacent the second outlet to prevent the ball from rolling from a position under the second outlet back to the first outlet.

24. The dishwasher of claim 20, wherein a step is formed at an upper portion of the passage adjacent the inlet to prevent the ball from moving from a position adjacent the inlet to the second outlet when washing water is pumped into the valve assembly through the inlet.

* * * * *